US005266007A

United States Patent [19]

Bushnell et al.

[11] Patent Number: 5,266,007

[45] Date of Patent: Nov. 30, 1993

[54] IMPELLER FOR TRANSVERSE FAN

[75] Inventors: Peter R. Bushnell, Cazenovia; Yehia M. Amr, Manlius, both of N.Y.

[73] Assignee: Carrier Corporation, Syracuse, N.Y.

[21] Appl. No.: 24,704

[22] Filed: Mar. 1, 1993

[51] Int. Cl.[5] ..... F04D 29/66

[52] U.S. Cl. ..... 416/178; 416/187; 416/200 R; 416/203; 415/119

[58] Field of Search ..... 416/178, 187, 203, 200 R; 415/119, 53.1

[56] References Cited

U.S. PATENT DOCUMENTS

| | | | |
|---|---|---|---|
| 4,253,800 | 3/1981 | Segawa et al. | 416/203 |
| 4,474,534 | 10/1984 | Thode | 416/203 |
| 4,538,963 | 9/1985 | Sagio et al. . | |
| 5,064,346 | 11/1991 | Atarashi et al. | 416/178 |

FOREIGN PATENT DOCUMENTS

| | | | |
|---|---|---|---|
| 17296 | 1/1985 | Japan | 416/178 |

OTHER PUBLICATIONS

R. C. Mellin & G. Sovran, *Controlling the Tonal Characteristics of the Aerodynamic Noise Generated by Fan Rotors*, Am. Soc'y of Mechanical Eng'rs Paper No. 69 WA FE-23 (1969).

*Primary Examiner*—Edward K. Look
*Assistant Examiner*—James A. Larson

[57] ABSTRACT

A transverse fan impeller (30) having at least two modules (32). Each module is defined by an adjacent pair of partition disks (34) each perpendicularly centered on the rotational axis of the impeller. Blades (31) extend longitudinally between pairs of partition disks. The angular spacing of blades in a module is nonuniform but also not random, being determined by application of certain formulae disclosed. The angular blade spacing within each module of the impeller is the same, but the modules are angularly offset so that a blade in one module is offset from the corresponding blade in an adjacent module by a predetermined value. The module and blade configurations reduce both the blade rate tonal noise and overall radiated noise produced as compared to an impeller having uniformly spaced blades.

5 Claims, 2 Drawing Sheets

IMPELLER FOR TRANSVERSE FAN

BACKGROUND OF THE INVENTION

This invention relates generally to the field of air moving apparatus such as fans and blowers. More specifically, the invention relates to an impeller for use in fans of the transverse type. Transverse fans are also known as cross-flow or tangential fans.

The operating characteristics and physical configuration of transverse fans make them particularly suitable for use in a variety of air moving applications. Their use is widespread in air conditioning and ventilation apparatus. Because such apparatus almost always operates in or near occupied areas, a significant design and manufacturing objective is quiet operation.

FIG. 1 shows schematically the general arrangement and air flow path in a typical transverse fan installation. FIG. 2 shows the main features of a typical transverse fan impeller. Fan assembly 10 comprises enclosure 11 in which is located impeller 30. Impeller 30 is generally cylindrical and has a plurality of blades 31 disposed axially along its outer surface. As impeller 30 rotates, it causes air to flow from enclosure inlet 21 through inlet plenum 22, through impeller 30, through outlet plenum 23 and out via enclosure outlet 24. Rear or guide wall 15 and vortex wall 14 each form parts of both inlet and outlet plena 22 and 23. The general principles of operation of a transverse fan are well known and need not be elaborated upon except as necessary to an understanding of the present invention.

When a transverse fan is operating, it generates a certain amount of noise. One significant component of the total noise output of the fan is a tone having a frequency related to the rotational speed of the fan multiplied by the number of fan blades (the blade rate tone). The passage of the blades past the vortex wall produces this blade rate tone. Discrete frequency noise is in general more irritating to a listener than broad band noise of the same intensity. The blade rate tone produced by the typical prior art transverse fan has limited the use of such fans in applications where quiet operation is required.

At least one prior art disclosure has proposed a means of reducing the blade rate tonal noise produced by a transverse fan. U.S. Pat. No. 4,538,963 (issued Sep. 3, 1985 to Sugio et al.) discloses a transverse fan impeller in which the circumferential blade spacing (called pitch angle in the patent) is random. Random blade spacing can be effective in reducing noise but can lead to problems in static and dynamic balance and to difficulties in manufacturing.

Blade rate tonal noise is not limited to fans of the transverse type. R. C. Mellin & G. Sovran, *Controlling the Tonal Characteristics of the Aerodynamic Noise Generated by Fan Rotors,* Am. Soc'y of Mechanical Eng'rs Paper No. 69 WA FE-23 (1969) (Mellin & Sovran) discusses the blade rate tonal noise associated with axial flow or propeller type fans and provides a technique for designing such a fan with unequal blade spacing so as to minimize blade rate tonal noise. Mellin & Sovran addresses axial fans only. Further, the authors wrote that their technique is limited to isolated rotors and that placing a body either upstream or downstream of the rotor would lead to acoustic interactions and the production of tones other than the blade rate tone. Not only does Mellin & Sovran not teach or suggest that its technique could be applied to fans of other than the axial flow type, it suggests that the presence of a body such as the vortex wall in a transverse fan installation would lead to interactions and production of tones such as to make questionable the application of the Mellin & Sovran technique to a transverse fan.

Further, at least one axial flow fan variant constructed according to the teaching of Mellin & Sovran will not be in balance, as the authors of the paper admit.

And Mellin & Sovran teaches that an axial flow fan with blades spaced by its method will have a reduced level of blade rate frequency noise, but that the overall noise level is approximately the same in comparison to a similar fan with equally spaced blades.

SUMMARY OF THE INVENTION

The present invention is a transverse fan impeller having a configuration that significantly reduces both the blade rate tone and the overall noise level compared to that produced by a conventional transverse fan impeller. We have achieved this reduction by applying the teaching of Mellin & Sovran regarding axial flow fans to arrive at a spacing of blades in a transverse fan. In addition, the impeller of the present invention can be made to be in static balance for any chosen variable of the Mellin & Sovran technique.

Rather than having blades that each extend completely across the span of the impeller, the impeller is divided longitudinally into at least two modules. The modules are defined by partition disks. Within each module, blades extend longitudinally between a pair of adjacent partition disks. The angular spacing of the blades around the circumference of each module is determined by application of the Mellin & Sovran technique. The blade arrangement in each module is identical.

Individual modules are arranged with respect to each other so that any given blade in one module is displaced circumferentially 360 degrees divided by the total number of modules in the impeller from the corresponding blade in an adjacent module. In this way, even if one module is statically imbalanced, the entire assembly of modules forming the complete impeller will be balanced.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 2:
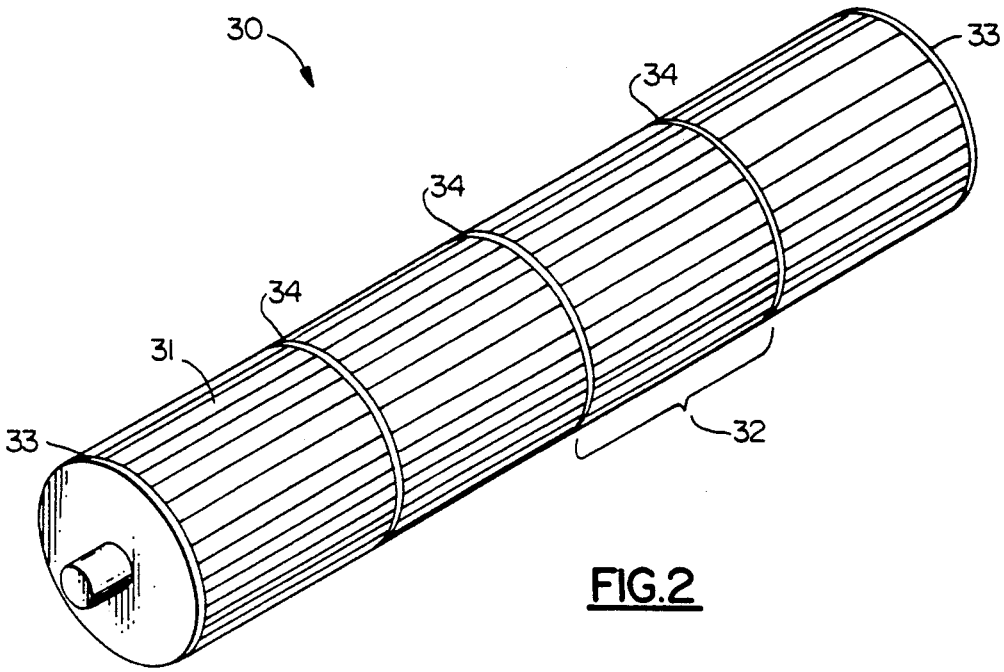
FIG. 2 is an isometric view of a transverse fan impeller.
Figure 1:
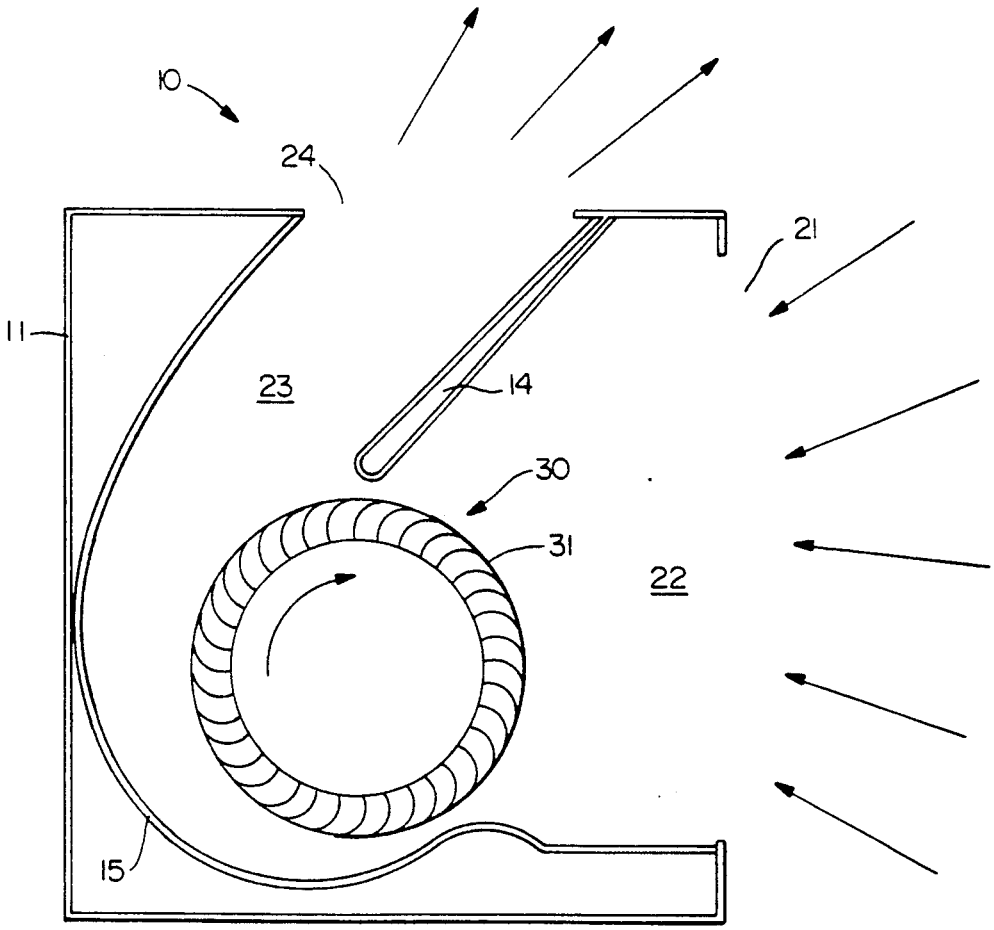
FIG. 1 is a schematic view of a typical transverse fan arrangement.

The BACKGROUND OF THE INVENTION section above, referring to FIGS. 1 and 2, provided information concerning the basic construction and operation of a transverse fan. An impeller embodying the present invention would be constructed like impeller 30 in FIG. 2. Impeller 30 comprises several modules 32, each defined by an adjacent pair of partition disks 33. Between each adjacent pair of disks longitudinally extend a plurality of blades 31. Each blade is attached at one of its longitudinal ends to one disk and at the other end to the other disk of the pair.

The plurality of blades 31 within each module 32 are not equally spaced around the circumference of the module. Rather, they are spaced according to the blade spacing technique disclosed in Mellin & Sovran for blades in an axial flow fan.

Mellin & Sovran provides the formula for blade spacing $$S'_n = \frac{360}{B + j\beta\cos\left[\frac{2\pi j}{B}\left(n - \frac{1}{2}\right)\right]}$$

where n is an integer from 1 to B,

B is the number of blades in a module, $S'_n$ is the uncorrected angular spacing between a point on the nth blade and a similar point on the (n+1)th blade, j is an integer $\geqq 1$ equal to the number of sinusoidal blade spacing modulation cycles around the circumference of the fan, and $\beta$ is a parameter $\geqq 0$ representing the degree of nonuniformity in blade spacing.

The above formula, depending on values chosen for B, j and $\beta$, may yield blade spacings that, when summed, do not equal 360°. Mellin & Sovran recognizes this and provides the formula $$S_n = S'_n \frac{360}{\sum_1^B S'_n}$$

where $S_n$ is the corrected angular blade spacing. This corrected angular blade spacing will produce a sum of all the individual angular blade spacings that equals 360°.

Figure 3:
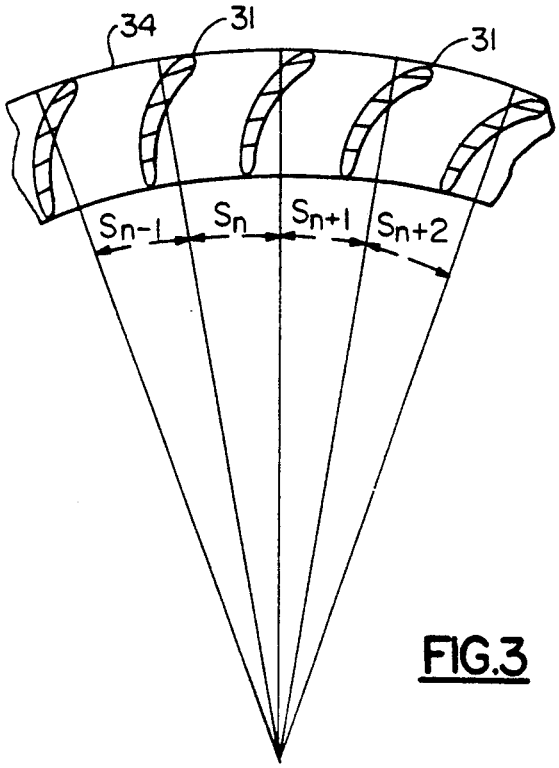
FIG. 3 is a cross section view of a portion of a partition ring and blade arrangement in a transverse fan impeller.

FIG. 3 shows a portion of a partition disk 34 with blades 31 in lateral cross section attached to it. The figure shows the individual blade spacing $S_n$ between blade number n and blade number n+1 together with spacings between their neighbors.

Mellin & Sovran contains a technique for determining an optimum value of $\beta$ ($\beta_{opt}$) as a function of B and j. The technique is embodied in the formula $$\beta_{opt} = a_0 + a_1(B/j) - a_2(B/j)^2 + a_3(B/j)^3$$

for values of $B/j \leqq 20$, where $a_0 = 8.964 \times 10^{-1}$, $a_1 = 8.047 \times 10^{-2}$, $a_2 = 4.730 \times 10^{-3}$ and $a_3 = 9.533 \times 10^{-5}$; and the formula $b_0 + b_1(B/j - 20)$ for values of $B/j > 20$, where $b_0 = 1.376$ and $b_1 = 1 \times 10^{-3}$.

We have determined that, for a transverse fan of the size that is appropriate for use in a typical ventilation or air conditioning application, the number of blades (B) in a module of the impeller should be in the range of 20 to 40.

If the number of sinusoidal blade spacing modulation cycles around the circumference of the fan (j) is equal to one, the fan will be statically unbalanced. This would be unacceptable in an axial flow fan but for a transverse fan embodying the present invention, for reasons that will be discussed below, even if j is equal to one, the fan will be in balance. Nevertheless, it is preferable that j be equal to at least two. If one chooses too large a value for j on the other hand, the resulting spacing between certain pairs of adjacent blades becomes unacceptably small and between others unacceptably large. We have found that a value of j in the range of two to eight produces good results.

Figure 4:
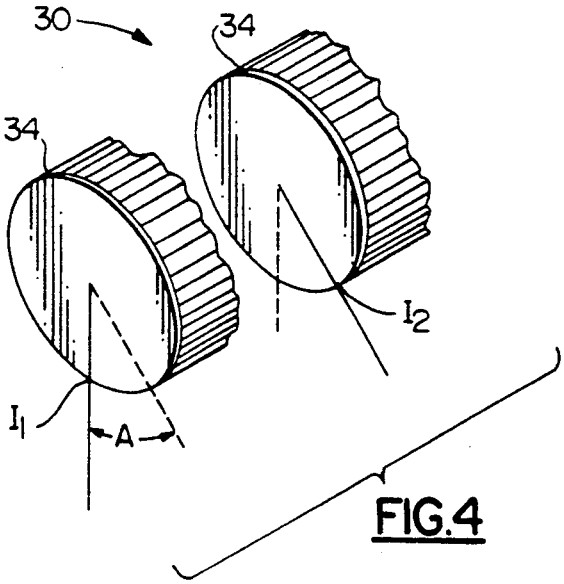
FIG. 4 is an isometric view, partially broken away, of a portion of a transverse fan impeller.

In a transverse fan impeller embodying the present invention, the blade spacing in each of the modules is the same, i.e. the spacing in each module is based on the same values of B, j and $\beta$. However, a blade in one module is displaced from the corresponding blade in an adjacent module by an angular amount equal to 360° divided by the total number of modules in a given impeller. To illustrate, FIG. 4 shows an isometric view, partially broken away, of two modules 32 of impeller 30. $I_1$ is the circumferential position of the nth blade in one module. $I_2$ is the circumferential position of the nth blade in the adjacent module. $I_2$ is circumferentially displaced from $I_1$ by angle A. A is equal to 360°/M, where M is the number of modules in the impeller. Because an impeller embodying the present invention will have at least two modules, each module can have a spacing that relates to a j equal to one. In the two module case, the point of minimum blade spacing, and therefore maximum weight, in one module will be displaced 180° from the point of minimum spacing in the other module. Thus the entire impeller, comprising the two modules taken together, will be balanced. If the impeller has three or more modules, the angular displacement between modules should, of course, be applied in the same direction, e.g. clockwise or counterclockwise, on succeeding modules from one end of the impeller to the other.

In a transverse fan impeller embodying the present invention, it is possible, if not likely, that there will be at least one blade in a given module that is at the same, or nearly the same, angular displacement as a blade in another module. The number of such "lineups" will not be great and do not reduce the benefits of positioning blades as described.

We have built and tested a fan using an impeller embodying the present invention. That impeller had 35 blades (B=35) and four blade modulation cycles around its circumference (j=4), yielding a $\beta_{opt}$ equal to 1.34. The following table shows the angular blade spacings (in degrees) that result:

| n | $S_n$ | $\sum_1^n S_n$ |
|---|---|---|
| 1 | 8.891 | 8.891 |
| 2 | 9.477 | 18.368 |
| 3 | 10.523 | 28.891 |
| 4 | 11.601 | 40.492 |
| 5 | 11.993 | 52.484 |
| 6 | 11.367 | 63.851 |
| 7 | 10.235 | 74.086 |
| 8 | 9.279 | 83.365 |
| 9 | 8.834 | 92.199 |
| 10 | 8.984 | 101.183 |
| 11 | 9.705 | 110.889 |
| 12 | 10.815 | 121.704 |
| 13 | 11.790 | 133.494 |
| 14 | 11.924 | 145.418 |
| 15 | 11.100 | 156.518 |
| 16 | 9.960 | 166.478 |

-continued

| n | $S_n$ | $\sum_1^n S_n$ |
|---|---|---|
| 17 | 9.114 | 175.592 |
| 18 | 8.815 | 184.408 |
| 19 | 9.114 | 193.522 |
| 20 | 9.960 | 203.484 |
| 21 | 11.101 | 214.582 |
| 22 | 11.924 | 226.506 |
| 23 | 11.790 | 238.296 |
| 24 | 10.815 | 249.111 |
| 25 | 9.705 | 258.817 |
| 26 | 8.984 | 267.801 |
| 27 | 8.834 | 276.635 |
| 28 | 9.279 | 285.914 |
| 29 | 10.235 | 296.149 |
| 30 | 11.367 | 307.516 |
| 31 | 11.993 | 319.508 |
| 32 | 11.601 | 331.109 |
| 33 | 10.523 | 341.632 |
| 34 | 9.477 | 351.109 |
| 35 | 8.891 | 360.000 |

The fan exhibited an eight db reduction in noise level in the one third octave band about the blade rate tonal frequency and a a six dba reduction the overall A weighted sound power level as compared to a similar fan having uniformly spaced blades.

We claim:

1. An improved impeller (30) for a transverse fan (10) of the type having at least three parallel disk members (34) axially spaced along and perpendicularly centered on the rotational axis of said impeller, and at least two blade modules (32), each comprising a plurality of blades (31), longitudinally aligned parallel to and extending generally radially outward from the rotational axis of said impeller and mounted between an adjacent pair of said disk members, the improvement comprising:

the angular spacing between similar points on adjacent pairs of said blades in each module being determined by the relationship $$S_n = S'_n \frac{360}{\sum_1^B S'_n}$$

where n is an integer from 1 to B,

B is the number of blades in a module, $S_n$ is the angular spacing between a point on the nth blade and a similar point on the (n+1)th blade, $S'_n$ is the uncorrected angular spacing between a point on the nth blade and a similar point on the (n+1)th blade, calculated from the formula $$S'_n = \frac{360}{B + j\beta \cos\left[\frac{2\pi j}{B}\left(n - \frac{1}{2}\right)\right]}$$

j is an integer $\geqq 1$ equal to the number of cycles of sinusoidal blade spacing modulation around the circumference of said module, and $\beta$ is a positive number equal to $8.8964\times10^{-1}+8.047\times10^{-2}$ (B/j)$-4.730\times10^{-3}$ $(B/j)^2+9.533\times10^{-5}$ $(B/j)^3$ for values of $B/j\leqq 20$ and equal to $1.376+0.001(B/j-20)$ for values of $B/j>20$; and the position of the nth blade in the (m+1)th module being circumferentially displaced from the nth blade in the mth module by a displacement equal to 360° divided by M, where m is an integer from 1 to M and M is the number of said modules in said impeller.

2. The impeller of claim 1 in which there are at least three of said modules and the position of the nth blade in the (m+2)th module is circumferentially displaced from the nth blade in the (m+1)th module in the same direction that the nth blade in the (m+1)th module is circumferentially displaced from the nth blade in the mth module.

3. The impeller of claim 1 in which $20\leqq B\leqq 40$ and $2\leqq j\leqq 8$.

4. The impeller of claim 1 in which

B=35, j=4 and $\beta=1.34$.

5. An improved impeller (30) for a transverse fan (10) of the type having at least three parallel disk members (34) axially spaced along and perpendicularly centered on the rotational axis of said impeller, and at least tow blade modules (32), each comprising a plurality of blades (31), longitudinally aligned parallel to and extending generally radially outward from the rotational axis of said impeller and mounted between an adjacent pair of said disk members, the improvement comprising:

the position of the nth blade in the (m+1)th module being circumferentially displaced from the nth blade in the mth module by a displacement equal to 360° divided by M, where m is an integer form 1 to M and M is the number of said modules in said impeller.

* * * * *